US009150334B2

(12) United States Patent
Duquet

(10) Patent No.: US 9,150,334 B2
(45) Date of Patent: Oct. 6, 2015

(54) FLUID DISPENSER

(71) Applicant: APTAR FRANCE SAS, Le Neubourg (FR)

(72) Inventor: Frederic Duquet, Crespieres (FR)

(73) Assignee: APTAR FRANCE SAS, Le Neubourg (FR)

( * ) Notice: Subject to any disclaimer, the term of this patent is extended or adjusted under 35 U.S.C. 154(b) by 0 days.

(21) Appl. No.: 14/134,734

(22) Filed: Dec. 19, 2013

(65) Prior Publication Data

US 2014/0175123 A1 Jun. 26, 2014

Related U.S. Application Data

(60) Provisional application No. 61/755,261, filed on Jan. 22, 2013.

(30) Foreign Application Priority Data

Dec. 20, 2012 (FR) ..... 12 62476

(51) Int. Cl.

| | |
|---|---|
| ***B65D 35/28*** | (2006.01) |
| ***B65D 35/24*** | (2006.01) |
| ***B05B 11/00*** | (2006.01) |
| ***B05B 11/04*** | (2006.01) |

(52) U.S. Cl.

CPC ..... *B65D 35/24* (2013.01); *B05B 11/0013* (2013.01); *B05B 11/0043* (2013.01); *B05B 11/047* (2013.01); *B05B 11/048* (2013.01); *B05B 11/0072* (2013.01)

(58) Field of Classification Search

CPC .... B65D 35/24; B65D 35/22; B05B 11/0013; B05B 11/0043; B05B 11/0072; B05B 11/047; B05B 11/048

USPC ..... 222/95, 212, 213, 207, 209, 481.5

See application file for complete search history.

(56) References Cited

U.S. PATENT DOCUMENTS 4,474,314 A * 10/1984 Roggenburg, Jr. ..... 222/494
5,033,647 A * 7/1991 Smith et al. ..... 222/94

(Continued)

FOREIGN PATENT DOCUMENTS

EP 0 473 994 A2 3/1992
EP 473994 A2 * 3/1992

(Continued)

OTHER PUBLICATIONS

French Search Report for French Patent Application No. 12 62476 dated Sep. 10, 2013.

(Continued)

*Primary Examiner* — Donnell Long
(74) *Attorney, Agent, or Firm* — Sughrue Mion, PLLC

(57) ABSTRACT

A fluid dispenser comprises a dispenser valve defining a fluid dispenser passage, and a container comprising a deformable inner pouch and a deformable outer shell that co-operate with each other to define an intermediate gap therebetween. The deformable outer shell includes a collar in engagement with the dispenser valve, and an annular flange that extends radially inwards inside the collar in such a manner as to define an edge that defines a central opening. The deformable inner pouch includes a neck that is engaged in the central opening in engagement with the edge of the annular flange and with the dispenser valve in fluid communication with the dispenser passage. The dispenser valve comprises an inlet sleeve in engagement with the neck of the deformable inner pouch and a fastener ring that in engagement with the collar of the deformable outer shell.

19 Claims, 1 Drawing Sheet

(56) References Cited

U.S. PATENT DOCUMENTS

| | | | | |
|---|---|---|---|---|
| 6,742,676 | B2 * | 6/2004 | Nakamura et al. | 222/95 |
| 2002/0190079 | A1 * | 12/2002 | Hamamoto | 222/105 |
| 2003/0089735 | A1 * | 5/2003 | Iwatsubo | 222/95 |
| 2006/0037968 | A1 | 2/2006 | Brenner | |

FOREIGN PATENT DOCUMENTS

| | | | |
|---|---|---|---|
| EP | 1 595 810 | A1 | 11/2005 |
| EP | 1 630 108 | A1 | 3/2006 |
| FR | 2 732 315 | A1 | 10/1996 |
| JP | 11-189251 | A | 7/1999 |
| JP | 11189251 | A * | 7/1999 |
| WO | 2012/059691 | A1 | 5/2012 |

OTHER PUBLICATIONS

French Written Opinion for French Patent Application No. 12 62476.

* cited by examiner

FLUID DISPENSER

CROSS REFERENCE TO RELATED APPLICATION

This application claims the benefit under 35 U.S.C. §119 (e) of U.S. provisional patent application Ser. No. 61/755,261, filed Jan. 22, 2013, and priority under 35 U.S.C. §119 (a)-(d) of French patent application No. FR-12.62476, filed Dec. 20, 2012.

TECHNICAL FIELD

The present invention relates to a fluid dispenser comprising a dispenser valve defining a fluid dispenser passage, and a container comprising a deformable inner pouch and a deformable outer shell that co-operate with each other to define an intermediate gap therebetween. By pressing on the outer shell, the inner pouch is squeezed, such that the fluid that it contains is forced towards the dispenser valve that opens under the effect of the pressure of the fluid. Advantageous fields of application of the present invention are the fields of cosmetics and pharmacy, without excluding foodstuffs, body care products, etc.

BACKGROUND OF THE INVENTION

In the prior art, document EP 0 473 994 A2 is already known, which describes a reservoir in the form of a flexible shell containing a flexible pouch that is associated with a dispenser valve that includes a flexible membrane that is perforated with an orifice that is closed by a pin. When the flexible outer shell is squeezed, the flexible inner pouch is also deformed, such that the fluid that it contains is put under pressure and forced towards the dispenser valve where it lifts the flexible membrane off from the pin. In greater detail, the flexible pouch defines an opening that is heat-sealed onto a rigid pouch support that is engaged in a rigid neck formed by the outer shell. The pouch support is held in place on the neck of the shell by the dispenser valve that is screw-fastened on a thread formed by the outer wall of the neck of the shell.

Thus, fabricating the reservoir of that dispenser requires a flexible pouch to be heat-sealed onto a rigid pouch support, and then requires the flexible pouch to be inserted through the rigid neck of the outer shell. Finally, the dispenser valve is screw-fastened on the neck of the outer shell.

An intermediate gap is thus formed between the pouch and the shell. The intermediate gap communicates with the outside through vent channels formed by the pouch support and the dispenser valve. The provision of the vent path for venting the intermediate gap is particularly complicated.

BRIEF SUMMARY OF THE INVENTION

An object of the present invention is to simplify the design of the prior-art pouch-in-shell reservoir, to make it easier to assemble, to improve the fastening and sealing of the dispenser valve, and to simplify the path for venting the intermediate gap.

In addition, in the prior art, document WO 2012/059691 A1 is also known, which describes a fluid dispenser head in the form of a valve that includes a flexible membrane of the differential type, i.e. the fluid under pressure is present on both faces of the membrane simultaneously. More precisely, the flexible membrane is perforated with a plurality of through holes so as to define a bottom chamber and a top chamber that communicate through the holes of the flexible membrane. The area of the top surface of the membrane that is subjected to the pressure of the fluid is larger than the area of the bottom surface of the membrane that is also subjected to the pressure of the fluid, such that the force exerted on the top surface is greater than the force exerted on the bottom surface. As a result, when the pressure of the fluid overcomes resilient spring means, the membrane moves in such a manner as to remove a closure pin that is engaged in sealed manner in a dispenser orifice while at rest.

The dispenser valve of that document includes a threaded connection sleeve for co-operating with a threaded neck of a fluid reservoir of capacity that varies.

Another object of the present invention is to improve the fastening and sealing of such a differential-membrane dispenser valve on a fluid reservoir comprising a pouch that is inserted inside an outer shell.

To achieve these objects, the present invention proposes a fluid dispenser comprising a dispenser valve defining a fluid dispenser passage, and a container comprising a deformable inner pouch and a deformable outer shell that co-operate with each other to define an intermediate gap therebetween, the shell including a collar in engagement with the dispenser valve, and an annular flange that extends radially inwards inside the collar in such a manner as to define an edge and a central opening, the pouch including a neck that is engaged in the opening in engagement with the edge of the flange and with the dispenser valve in fluid communication with the dispenser passage, the dispenser valve comprising an inlet sleeve in engagement with the neck of the deformable inner pouch and a fastener ring that in engagement with the collar of the deformable outer shell. Thus, the valve is mounted with a maximal stability on the container. Advantageously, inlet sleeve is snap-fastened in the neck of the deformable inner pouch in a leaktight manner.

According to another feature of the invention, the dispenser valve comprises a base forming the inlet sleeve and the fastener ring. Preferably, the base is an integral piece.

According to an advantageous embodiment, an annular housing is defined between the collar and the neck, a portion of the dispenser valve being engaged in the annular housing. This makes it possible to reduce the height of the valve considerably, given that the collar and the neck do not define dead space. Advantageously, the base forms an annular trough which is disposed in the annular housing.

The annular flange makes it possible to space the collar apart from the neck, and this increases the stability of the valve on the reservoir.

The collar, which extends at a distance from the neck, makes it possible to provide peripheral fastening, whereas the neck that occupies a more central position makes it possible to provide fastening and sealing at the axis of the valve. It can also be said that the collar makes it possible to provide peripheral stability or fastening, whereas the neck makes it possible to provide central fastening and sealing. In addition, it should be observed that the neck of the pouch becomes engaged, advantageously snap-fastened, with the edge of the flange of the shell, and not with its collar. It should also be observed that the flexible pouch does not require a heat-sealed rigid pouch support. Thus, fabricating the pouch and assembling it in the shell are greatly simplified. The same applies for assembling the valve on the reservoir, given that the collar and the neck both offer guidance, both peripheral guidance and central guidance.

Advantageously, the intermediate gap communicates with the outside along a vent path that passes between the edge of the flange and the neck, through the annular housing, and between the collar and the dispenser valve.

Preferably, the edge of the flange forms at least one vent notch that puts the intermediate gap into communication with the outside. Thus, even if the neck is in intimate airtight contact with the edge of the flange, the vent notch nevertheless ensures a passage that puts the intermediate gap into communication with the outside.

According to another feature of the invention, the dispenser valve defines a dispenser orifice that is closed selectively by a pin that is mounted on a differential membrane that is in contact with the fluid on both of its faces simultaneously.

In another advantageous aspect of the invention, the outer wall of the neck forms a snap-fastener profile that is in engagement with the edge of the flange. It is thus guaranteed that the pouch and the shell are assembled together as soon as snap-fastening takes place.

In another aspect of the invention, the neck of the pouch extends from a substantially annular shoulder, the flange of the shell extending substantially parallel to the shoulder and spaced apart therefrom by very little. It is thus guaranteed that the pouch is completely stable inside the shell.

According to another characteristic of the invention, the neck may extend in the collar with an offset that corresponds substantially to the diameter of the neck. This characteristic makes it possible to quantify the offset between the neck and the collar in terms of neck diameter.

According to another characteristic of the invention, the collar is snap-fastened on the dispenser valve in non-airtight manner.

According to another characteristic of the invention, the pouch and the shell are heat-sealed together at their ends remote from the dispenser valve. Thus, the pouch and the shell may be made in the form of tubes that are heat-sealed together. The pouch may thus be inserted into the shell, then filled with fluid, and finally heat-sealed.

The spirit of the invention resides in fastening the dispenser valve both to the shell and to the pouch. Another principle resides in spacing apart the fastenings to the shell and to the pouch, in such a manner as to increase the stability of the dispenser valve on the reservoir. The snap-fastening of the pouch in the shell, followed by the snap-fastening of the valve to the shell and to the pouch make it possible to simplify greatly the operation of assembling the dispenser.

BRIEF DESCRIPTION OF THE DRAWINGS

The invention is described more fully below with reference to the accompanying drawing that shows an embodiment of the invention by way of non-limiting example.

In the figures.

DETAILED DESCRIPTION

Figure 1:
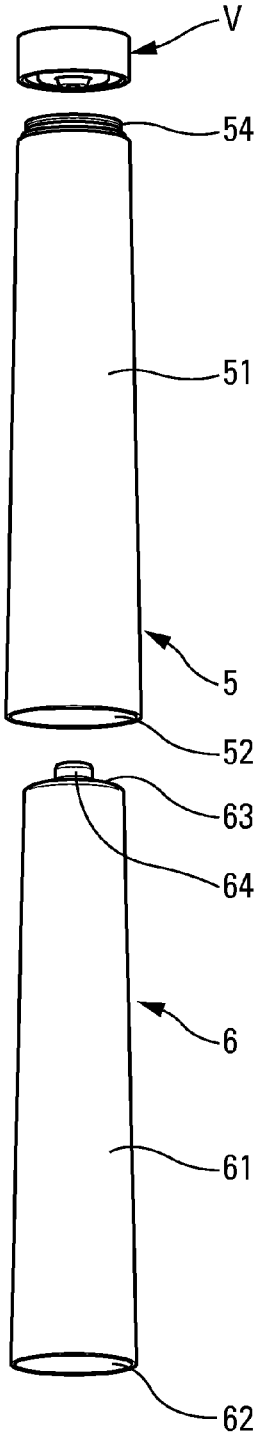
FIG. 1 is an exploded perspective view of a fluid dispenser in an embodiment of the invention.
Figure 2:
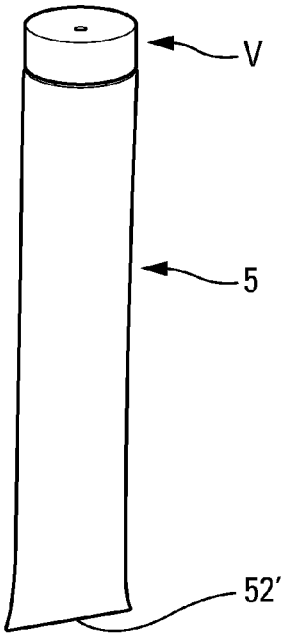
FIG. 2 is a perspective view of the FIG. 1 dispenser in its assembled state.

Reference is made firstly to FIGS. 1 and 2 in order to describe in very general manner the structure of a fluid dispenser of the invention. The dispenser comprises three essential component elements, namely a shell 5 and a pouch 6 that co-operate with each other to form a fluid reservoir R, and a dispenser valve V that is assembled on the reservoir R.

The shell 5 and the pouch 6 are both deformable or flexible so as to be suitable for being deformed or squeezed manually, advantageously with one hand. The shell 5 preferably presents elastic shape memory, so that it returns to its initial rest shape once it is no longer stressed. The pouch 6 may be designed with or without elastic shape memory.

The shell 5 comprises a tube 51 that presents a bottom end 52 that is open in its initial state before final assembly of the dispenser. At its top end, the shell forms a substantially annular flange 53 that extends radially inwards. The flange includes a central opening that is defined by an annular edge 55. The edge may be circular or oval, and it preferably includes a vent notch 56 having a function that is described in more detail below. A collar 54 projects upwards from the annular flange 53. It is arranged in the proximity of the outer periphery of the annular flange 53. The collar 54 advantageously presents one or more fastener or snap-fastener profiles on its outer wall.

The pouch 6 also comprises a tube 61 that presents an open bottom end 62 in its initial state before final assembly of the dispenser. At its top end, the pouch 6 forms a substantially annular shoulder 63 that extends upwards from its inner periphery so as to form a projecting neck 64. The neck is advantageously provided with a snap-fastener bead 65 on its outer wall, and with a snap-fastener groove 66 on its inner wall.

The pouch 6 is inserted into the shell 5 through its open end 52. The neck 64 is engaged in the flange 53: the outer wall of the neck becoming engaged, advantageously snap-fastened, with the edge 55 of the flange 53. The snap-fastener bead 65 may be forced above the flange 53. Preferably, the contact between the neck and the edge 55 of the flange is not airtight. In any event, the vent notch 56 enables any potentially airtight contact to be broken. It should be observed that the flange 53 and the shoulder 63 are spaced apart by very little, or are possibly even in contact.

It should be observed that the collar 54 extends coaxially around the neck 64, with an offset that is about the same as the diameter of the neck. The offset is created by the annular flange 53 that connects the collar to the neck. Thus, an annular housing L is formed between the collar and the neck: its bottom is formed by the flange 53.

The pouch may thus be filled with fluid via its open end 62. The open ends 52, 62 of the shell and the pouch are then pinched and heat-sealed in such a manner as to form a heat-sealed joint 52', as can be seen in FIG. 2.

An intermediate gap E is thus formed between the pouch and the shell. The gap E communicates with the outside at the neck 64 that is engaged in non-airtight manner in the flange 53 that is possibly provided with a vent notch 56.

By squeezing the shell 5, e.g. with one hand, the pouch 6 is also squeezed and fluid is forced out from the pouch. The shell preferably returns to its initial shape, whereas the pouch may remain deformed, given that it is masked by the shell.

Figure 3:
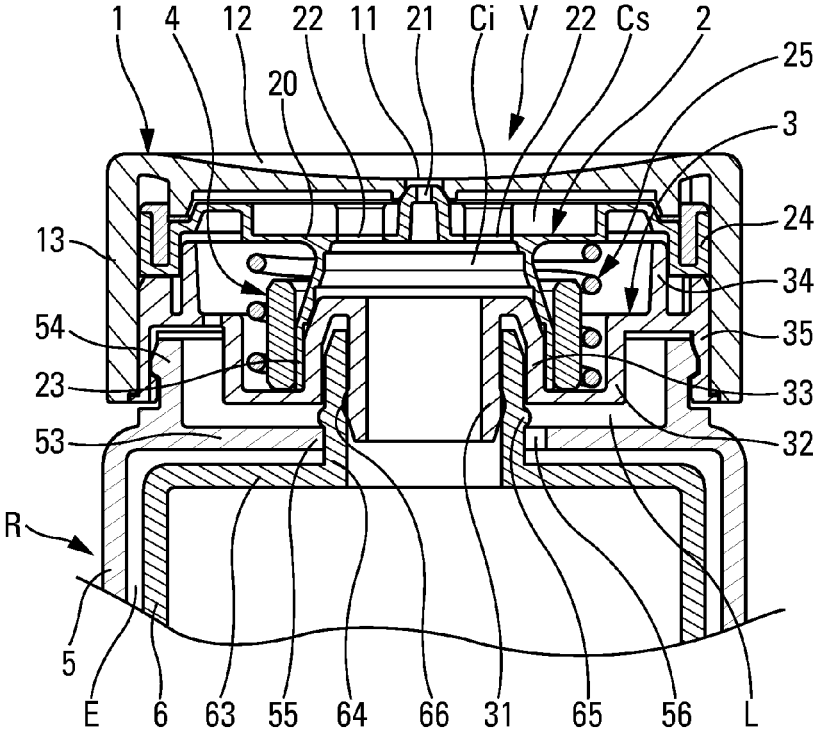
FIG. 3 is a vertical section view through the dispenser valve and through the top portion of the reservoir.

The dispenser valve V shown in detail in FIG. 3 comprises three essential component elements, namely a cover 1, a flexible part 2, and a base 3. The elements may be made by injection-molding appropriate plastics material. They all present more or less perfect circular symmetry. The cover 1 and the base 3 are substantially rigid, while the flexible part 2 is elastically deformable, by definition. The cover 1 and the associated base 3 co-operate with each other to form a kind of casing in which the flexible part 2 is housed, as described below. The flexible part 2 defines seals both with the cover 1 and with the base 3, as described below.

In this particular embodiment, the cover 1 is in the form of a lid including a collection dish 12 at the center of which there is formed a dispenser orifice 11. On its outer periphery, the cover 1 forms a skirt 13 that is substantially cylindrical. In this embodiment, the cover 1 presents a cross-section that is circular, but it is also possible to envisage some other cross-section shape for the cover 1.

The flexible part 2 constitutes a kind of motor of the dispenser valve, since it defines the dynamic portion of the valve. The flexible part 2 initially defines a flexible membrane 20 in the shape of a disk. The membrane 20 has a plurality of through holes 22 passing therethrough. At its center, the membrane 20 defines a closure member in the form of a sealing closure pin 21 that projects upwards. The membrane 20 defines a top face and a bottom face. The pin 21 is situated on the top face. The through holes 22 make it possible to communicate directly from the top face to the bottom face. The flexible part 2 also defines a first anchor stub 23 that extends downwards from the bottom face of the membrane. The anchor stub 23 defines a bellows segment that enables axial contraction. On its outer periphery, the flexible membrane 20 is connected to a second anchor stub 24. A return spring 25 that bears against the bottom face of the membrane 20 urges the pin 21 into the orifice 11 in such a manner as to close it.

The base 3 includes an inlet sleeve 31 that is advantageously provided, on its outer wall, with a snap-fastener bead for co-operating with the snap-fastener groove 66 formed inside the neck 64. Beyond the inlet sleeve 31, the base forms an annular trough 32 having an inner wall 33 that extends substantially coaxially to the outside of the inlet sleeve 31. Beyond the annular trough 32, the base forms an annular bushing 34 that projects upwards. To finish, the base forms a fastener ring 35 that is advantageously provided, on its inside face, with a snap-fastener housing.

The dispenser valve V also comprises a locking ring 4 that is arranged in the trough 32 in such a manner as to flatten the first anchor stub 23 of the flexible part 2 in sealing manner against the inner wall 33 of the trough 32. The blocking ring 4 performs both a fastening and a sealing function.

The various component elements of the dispenser valve V are assembled together as follows. As mentioned above, the first anchor stub 23 of the flexible part 2 is firstly jammed between the wall 33 and the blocking ring 4. The return spring 25 bears firstly against the bottom of the trough 32, and secondly against the underside of the membrane 20 of the flexible part 2. Putting the cover 1 into place makes it possible to jam the second anchor stub 24 of the flexible part 2 against the bushing 34 of the base 3. In addition, the pin 21 is engaged in resilient and sealing manner in the dispenser orifice 11. The skirt 13 of the cover 1 is force-fitted around the fastener ring 35 of the base 3. A bottom chamber Ci is thus formed below the membrane 20. The bottom chamber Ci extends into the inlet sleeve 31. In addition, a top chamber Cs is formed between the membrane 20 and the cover 1, around the pin 21. The bottom and top chambers Ci, Cs communicate with each other through the through holes 22. The dispenser valve V thus defines a dispenser passage that extends from the inlet sleeve 31 to the dispenser orifice 11, passing via the bottom chamber Ci, the through holes 22, the top chamber Cs, and the passage formed around the pin 21 when said pin lifts off from the orifice 11.

When the fluid under pressure coming from the reservoir R reaches the dispenser valve, it fills the bottom and top chambers Ci and Cs that communicate easily with each other via the through holes 22. In the bottom chamber Ci, the pressure is exerted on a fraction of the bottom face of the membrane 20, which fraction is referred to herein as the bottom surface area Si. On the other side of the membrane 20, the pressure is exerted on a fraction of the top face of the membrane, which fraction is referred to herein as the top surface area Ss. It should easily be observed that the bottom surface area Si is much smaller than the top surface area Ss. The surface area ratio Ss/Si is about 3 or 4 for the embodiment shown in the figures. As a result, the force exerted by the pressure of the fluid on the surface area Ss is much greater than the force exerted by the pressure of the fluid on the bottom surface area Si. In response to pressure, the flexible membrane 20 moves relative to the cover 1 and to the base 3 in such a manner as to remove the closure pin 21 from the dispenser orifice 11. The movement of the membrane is generated merely by the pressure of the fluid, such that the membrane may be referred to as a differential membrane since it reacts to the difference between the pressure forces exerted on the two faces. The volume of the top chamber Cs increases while the volume of the chamber Ci decreases as the pressure increases. However, given that the flexible membrane 20 is urged resiliently towards the cover 1 by the resilient means, it is necessary for the pressure inside the chambers to reach a predetermined pressure threshold making it possible to overcome the resilient means. The resilient means are the result of combining a plurality of individual means, namely the elasticity proper of the membrane 20, the elasticity provided by the first anchor stub 23, and the elasticity of the spring 25.

At rest, as shown in FIG. 3, the orifice 11 comes into sealing contact with the closure pin 21. Thus, the top chamber Cs is isolated in completely sealed manner from the outside. In contrast, during the dispensing stages, the pin 21 lifts off from the edge of the orifice 11, thereby opening up an outlet passage for the fluid by putting the top chamber Cs into communication with the outside.

The internal design of the dispenser valve V is not critical for the present invention. Any dispenser valve may be used in the context of the present invention, so long as it incorporates the characteristics that are necessary to enable it to co-operate with the reservoir of the invention. In other words, the dispenser valve must incorporate a base that presents a configuration that is identical or substantially similar to the configuration described above.

The dispenser valve V is assembled on the reservoir R as follows. Simultaneously, the inlet sleeve 31 is inserted into the neck 64, the inner wall 33 of the trough 32 is engaged around the neck 64, the trough 32 penetrates into the housing L, and the fastener ring 35 comes into engagement with the collar 54. In the final assembled position shown in FIG. 3, the outer snap-fastener profiles of the sleeve 31 are housed in the annular groove 66 of the neck 64 in a leaktight manner, the trough 32 is received, almost completely, inside the housing L, and the fastener ring 35 is snap-fastened around the collar 54. Advantageously, the contact between the fastener ring 35 and the collar 54 is not airtight, such that the intermediate gap E may communicate with the outside through the non-airtight contact between the neck and the edge of the flange 53, the housing L, and the non-airtight contact between the ring 35 and the collar 54. It should be observed that inserting a portion of the valve, namely the trough 32, into the housing L enables the total height of the valve to be reduced considerably, and consequently enables its size to be reduced considerably. It can be seen in FIG. 3 that the blocking ring 4, a portion of the spring 25, and a portion of the first anchor stub 23 are arranged inside the housing L.

By implementing a peripheral collar secured to the shell and a central neck secured to the pouch, the fastening and hold of the dispenser valve V on the reservoir are considerably improved.

By means of the invention, it is possible to associate, in particularly solid and sealed manner, a dispenser valve (advantageously having a differential membrane) with a pouch-in-shell reservoir.

The invention claimed is:

1. A fluid dispenser comprising a dispenser valve defining a fluid dispenser passage, and a container comprising a deformable inner pouch and a deformable outer shell that co-operate with each other to define an intermediate gap therebetween;

the deformable outer shell including a collar in engagement with the dispenser valve, and an annular flange that extends radially inwards inside the collar in such a manner as to define an edge that defines a central opening, the deformable inner pouch including a neck that is engaged in the central opening in engagement with the edge of the annular flange and with the dispenser valve in fluid communication with the dispenser passage, wherein the dispenser valve comprises an inlet sleeve in engagement with the neck of the deformable inner pouch and a fastener ring that is in engagement with the collar of the deformable outer shell.

2. A dispenser according to claim 1, wherein the inlet sleeve is snap-fastened in the neck of the deformable inner pouch in a leaktight manner.

3. The dispenser according to claim 2, wherein the dispenser valve-comprises a base forming the inlet sleeve and the fastener ring.

4. A dispenser according to claim 1, wherein the dispenser valve comprises a base forming the inlet sleeve and the fastener ring.

5. A dispenser according to claim 1, wherein an annular housing is defined between the collar and the neck, a portion of the dispenser valve being engaged in the annular housing.

6. A dispenser according to claim 5, wherein the dispenser valve comprises a base forming the inlet sleeve and the fastener ring, the base also forming an annular trough which is disposed in the annular housing.

7. A dispenser according to claim 5, wherein the intermediate gap communicates with the outside along a vent path that passes between the edge and the neck, through the annular housing, and between the collar and the dispenser valve.

8. A dispenser according to claim 1, wherein the dispenser passage of the dispenser valve defines a dispenser orifice that is closed selectively by a pin that is mounted on a differential membrane that is in contact with the fluid on both of faces of the differential membrane simultaneously.

9. A dispenser according to claim 1, wherein the edge of the annular flange forms at least one vent notch that puts the intermediate gap into communication with the outside.

10. A dispenser according to claim 1, wherein the outer wall of the neck forms a snap-fastener profile that is in engagement with the edge of the annular flange.

11. A dispenser according to claim 1, wherein the neck of the deformable inner pouch extends from a substantially annular shoulder, the annular flange of the deformable outer shell extending substantially parallel to the substantially annular shoulder.

12. A dispenser according to claim 11, wherein the annular flange of the deformable outer shell is spaced apart from the substantially annular shoulder.

13. A dispenser according to claim 1, wherein the neck extends in the collar with an offset that corresponds substantially to the diameter of the neck.

14. A dispenser according to claim 1, wherein the collar is snap-fastened on the dispenser valve in non-airtight manner.

15. A dispenser according to claim 1, wherein the deformable inner pouch and the deformable outer shell are heat-sealed together at their ends remote from the dispenser valve.

16. The dispenser according to claim 1, wherein the collar surrounds the flange and protrudes upwardly from the flange.

17. The dispenser according to claim 16, wherein the collar is a one-piece integral construction with the flange.

18. A fluid dispenser comprising a dispenser valve defining a fluid dispenser passage, and a container comprising a deformable inner pouch and a deformable outer shell that co-operate with each other to define an intermediate gap therebetween;

the deformable outer shell including a collar in engagement with the dispenser valve, and an annular flange that extends radially inwards inside the collar in such a manner as to define an edge that defines a central opening, the deformable inner pouch including a neck that is engaged in the central opening in engagement with the edge of the annular flange and with the dispenser valve in fluid communication with the dispenser passage, wherein an annular housing is defined between the collar and the neck, a portion of the dispenser valve being engaged in the annular housing.

19. A dispenser according to claim 18, wherein the dispenser valve comprises a base forming the inlet sleeve and the fastener ring, the base also forming an annular trough which is disposed in the annular housing.

* * * * *